US010051934B1

(12) United States Patent
Zhang

(10) Patent No.: US 10,051,934 B1
(45) Date of Patent: Aug. 21, 2018

(54) CASE FOR PORTABLE COMPUTING DEVICE

(71) Applicant: Lina Zhang, Bayside Hills, NY (US)

(72) Inventor: Lina Zhang, Bayside Hills, NY (US)

( * ) Notice: Subject to any disclaimer, the term of this patent is extended or adjusted under 35 U.S.C. 154(b) by 0 days.

(21) Appl. No.: 15/423,246

(22) Filed: Feb. 2, 2017

(51) Int. Cl.
*A45C 11/00* (2006.01)
*A45C 13/00* (2006.01)
*A45F 5/00* (2006.01)

(52) U.S. Cl.
CPC ..... *A45C 11/00* (2013.01); *A45C 13/002* (2013.01); *A45F 5/00* (2013.01); *A45C 2011/002* (2013.01); *A45C 2011/003* (2013.01)

(58) Field of Classification Search
CPC ..... A45C 11/00; A45C 13/002; A45F 5/00
USPC ..... 206/320, 305; 455/575.1, 575.8; 361/679.01, 679.02
See application file for complete search history.

(56) References Cited

U.S. PATENT DOCUMENTS

| | | | | |
|---|---|---|---|---|
| 7,965,500 | B1 | 6/2011 | Bruce et al. | |
| 8,245,842 | B2 | 8/2012 | Bau | |
| D670,279 | S | 11/2012 | Veltz et al. | |
| D671,932 | S | 12/2012 | Azoulay | |
| D682,816 | S | 5/2013 | Fathollahi | |
| D685,358 | S | 7/2013 | Armstrong et al. | |
| 8,509,865 | B1 * | 8/2013 | LaColla | H04M 1/04 455/556.1 |
| 8,544,644 | B2 | 10/2013 | Meehan | |
| 8,584,847 | B2 | 11/2013 | Tages et al. | |
| D709,869 | S | 7/2014 | Witter et al. | |
| 8,774,882 | B2 | 7/2014 | Tages et al. | |
| D717,775 | S | 11/2014 | Hemesath et al. | |
| D719,144 | S | 12/2014 | Eulette | |
| D725,116 | S | 3/2015 | Li | |
| D733,698 | S | 7/2015 | Suzuki et al. | |
| 9,075,570 | B2 | 7/2015 | Yuan | |
| 9,098,238 | B2 | 8/2015 | Richardson et al. | |
| D742,868 | S | 11/2015 | Odhwani | |
| D742,869 | S | 11/2015 | Odhwani | |
| 9,182,785 | B2 | 11/2015 | Wyner et al. | |
| 9,241,053 | B2 | 1/2016 | Ashley et al. | |
| 9,247,795 | B2 | 2/2016 | Kim | |
| 9,266,664 | B2 | 2/2016 | Bau | |
| D754,115 | S | 4/2016 | Lin | |
| 9,363,912 | B2 | 6/2016 | Senatori | |
| D764,451 | S | 8/2016 | Hung et al. | |
| D766,885 | S | 9/2016 | Armstrong et al. | |
| 2004/0025993 | A1 | 2/2004 | Russell | |
| 2007/0227923 | A1 * | 10/2007 | Kidakarn | A63F 13/02 206/320 |
| 2008/0308437 | A1 * | 12/2008 | Lin | G06F 1/1616 206/320 |
| 2012/0217257 | A1 * | 8/2012 | Ting | G06F 1/1628 220/660 |
| 2014/0069825 | A1 | 3/2014 | Macrina et al. | |
| 2014/0220270 | A1 | 8/2014 | Hung | |

(Continued)

FOREIGN PATENT DOCUMENTS

WO WO2013069005 A3 5/2013

*Primary Examiner* — Chun Cheung
(74) *Attorney, Agent, or Firm* — Jeanette Meng Nakagawa

(57) ABSTRACT

The present disclosure is a layered protective case for a portable computing device with a unique structure to alleviate force from physical impact and to facilitate heat dissipation. Various embodiments are discussed to illustrate options of trade offs between several desired parameters.

18 Claims, 8 Drawing Sheets

(56) References Cited

U.S. PATENT DOCUMENTS

| | | | |
|---|---|---|---|
| 2015/0068934 | A1 | 3/2015 | Armstrong |
| 2015/0327657 | A1 | 11/2015 | Roberts et al. |
| 2016/0058143 | A1 | 3/2016 | Tien |
| 2016/0182114 | A1 | 6/2016 | Tien |
| 2016/0198026 | A1 | 7/2016 | Del Toro et al. |

* cited by examiner

601

602

702

CASE FOR PORTABLE COMPUTING DEVICE

CROSS-REFERENCES TO RELATED APPLICATIONS

A U.S. Design patent application Ser. No. 29/583,945 was filed on Nov. 10, 2016 with an outside view of one of the embodiments among the present disclosure. The design application is currently pending examination at the USPTO, and has not been published as of the filing date of the present utility application.

TECHNICAL FIELD

The present disclosure relates to a protective case for portable computing devices. More specifically, the present specification discloses a case with a unique frame structure to defuse force from impact, to facilitate ventilation of heat generated by the device, and thus to better protect the device in which it encases.

BACKGROUND OF THE DISCLOSURE

Computing devices such as laptops, phones and tablets are becoming more and more portable. They strive to be lighter and thinner than ever, yet to have more powerful computing capacity and speed than their predecessors. These types of devices are still relatively expensive, and therefore require protection even when they are handled with care. The present disclosure supports a case for this very purpose, taking into consideration the force and pattern of impact, as well as the need of heat dissipation.

BRIEF SUMMARY OF EMBODIMENTS OF THE DISCLOSURE

The present disclosure relates to a protective case for portable computing devices. More specifically, the present specification discloses a case with a unique frame structure to defuse force from impact, to facilitate ventilation of heat generated by the device, and thus to better protect the device in which it encases.

In a variant, the protective case comprises a first protective layer configured to enclose and to capture at least a portion of a body and a portion of a perimeter of the electronic device, wherein the first protective layer further comprises a structure with large connected openings clustered and distributed around a central region of the body of the electronic device, and with small connected openings clustered and distributed around edges and corners of the electronic device; a second cushion layer, disposed between the first protective layer and the electronic device, configured to mirror and to interlock with the structure of the first protective layer; and a third base layer to support the electronic device on a resting surface, wherein the base layer further comprises multiple sets of slits to facilitate heat dissipation.

In another variant, the large connected openings comprise polygons with abutting edges and corners.

In yet another variant, the small connected openings comprise polygons with abutting edges and corners.

In still another variant, large connected openings are circular in nature.

In a variant, the small connected openings are circular in nature.

In another variant, the large connected openings comprise irregular shapes abutting on anther.

In yet another variant, the small connected openings comprise irregular shapes abutting on another.

In still another variant, the structure of the large and small openings follows a continuous fractal pattern with density of the fractal pattern increases towards edges and corners of the electronic device.

In a variant, the first protective layer comprises mainly thermoplastic polyurethane.

In another variant, the second cushion layer comprises mainly polycarbonate.

In still another variant, the third base layer further comprises at lease one pair of feet to raise the base layer above a resting surface.

In a variant, the protective case for a portable computing device, comprises a first protective layer configured to enclose and to capture at least a portion of a body and a portion of a perimeter of the electronic device, wherein the first protective layer further comprises a structure with large connected openings clustered and distributed around a central region of the body of the electronic device, and with small connected openings clustered and distributed around edges and corners of the electronic device; and a second cushion layer, disposed between the first protective layer and the electronic device, configured to mirror and to interlock with the structure of the first protective layer.

In another variant, the large and small connected openings comprises polygons with abutting edges and corners.

In yet another variant, the large and small connected openings are circular in nature.

In still another variant, the large and small connected openings comprises irregular shapes abutting on anther.

In a variant, the structure of the large and small openings follows a continuous fractal pattern with density of the fractal pattern increases towards edges and corners of the electronic device.

In another variant, the first protective layer comprises mainly thermoplastic polyurethane.

In yet another variant, the second cushion layer comprises mainly polycarbonate.

In still another variant, the first protective layer further comprises at least one protrusion around its corners.

Other features and aspects of the disclosure will become apparent from the following detailed description, taken in conjunction with the accompanying drawings, which illustrate, by way of example, the features in accordance with embodiments of the disclosure. The summary is not intended to limit the scope of the disclosure, which is defined solely by the claims attached hereto.

BRIEF DESCRIPTION OF THE DRAWINGS

The present disclosure, in accordance with one or more various embodiments, is described in detail with reference to the following figures. The drawings are provided for purposes of illustration only and merely depict typical or example embodiments of the disclosure. These drawings are provided to facilitate the reader's understanding of the disclosure and shall not be considered limiting of the breadth, scope, or applicability of the disclosure. It should be noted that for clarity and ease of illustration these drawings are not necessarily made to scale.

Some of the figures included herein illustrate various embodiments of the disclosure from different viewing angles. Although the accompanying descriptive text may refer to such views as "top," "bottom" or "side" views, such references are merely descriptive and do not imply or require that the disclosure be implemented or used in a particular spatial orientation unless explicitly stated otherwise.

The figures are not intended to be exhaustive or to limit the disclosure to the precise form disclosed. It should be understood that the disclosure can be practiced with modification and alteration, and that the disclosure be limited only by the claims and the equivalents thereof.

DETAILED DESCRIPTION OF THE EMBODIMENTS OF THE DISCLOSURE

From time-to-time, the present disclosure is described herein in terms of example environments. Description in terms of these environments is provided to allow the various features and embodiments of the disclosure to be portrayed in the context of an exemplary application. After reading this description, it will become apparent to one of ordinary skill in the art how the disclosure can be implemented in different and alternative environments.

Unless defined otherwise, all technical and scientific terms used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
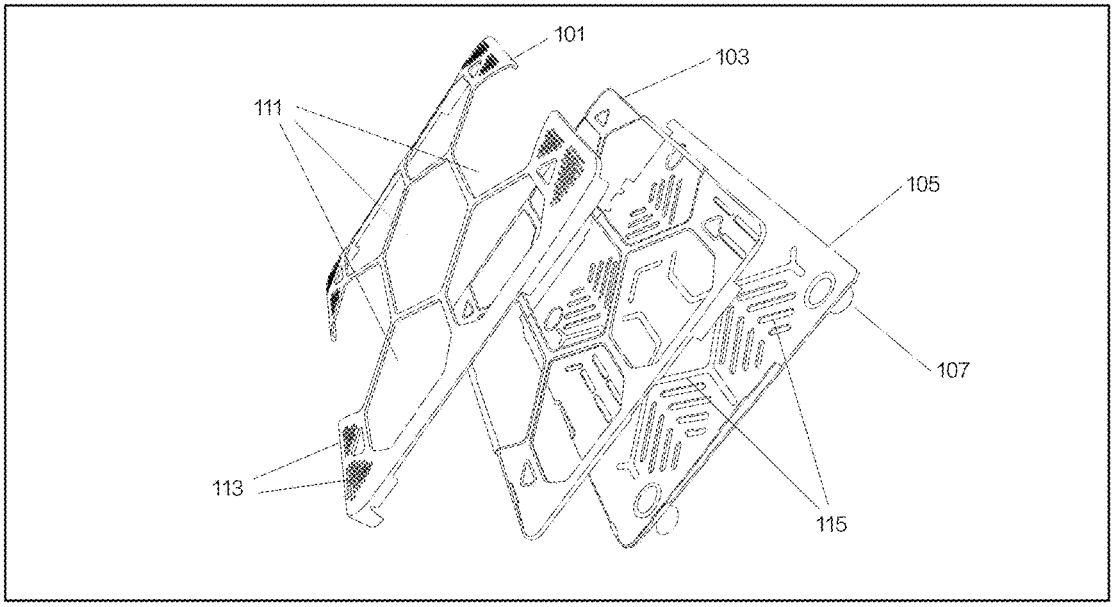
FIG. 1 is a schematic illustration of a case comprising multiple layers according to some embodiments of the present disclosure.
Figure 2:
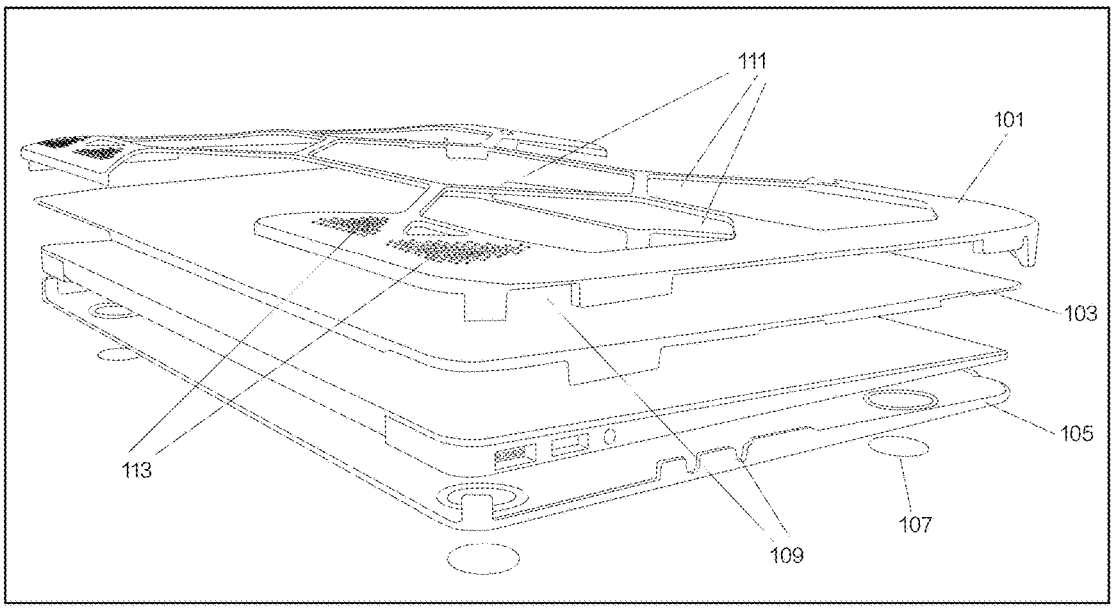
FIG. 2 is an alternative view of the case comprising multiple layers with respect to the computing device that it protects.

FIGS. 1 and 2 are schematic illustrations of a case comprising multiple layers according to some embodiments of the present disclosure. The protective case comprises mainly three layers, a harder protective layer 101, a transparent softer cushion layer 103, which largely mirrors layer 101, and a base layer 105. A laptop is positioned as an example in FIG. 2 between layers 103 and 105.

When the protective case is assembled, layers 101 and 103 are snapped together. They partially cover the top surface of the laptop and engage the top panel of the laptop around its corners and perimeters. Base layer 105 partially covers the bottom surface of the laptop and engages the bottom panel around its corners and perimeters. The bottom panel may comprise multiple sets of feet 107 to raise the entire device slightly above a supporting surface. Various gaps and openings can be customized to accommodate input and output requirements around the encased device. For instance in FIGS. 1 and 2 openings 109 are for power outlet, USB port, and audio port respectively.

Figure 6:
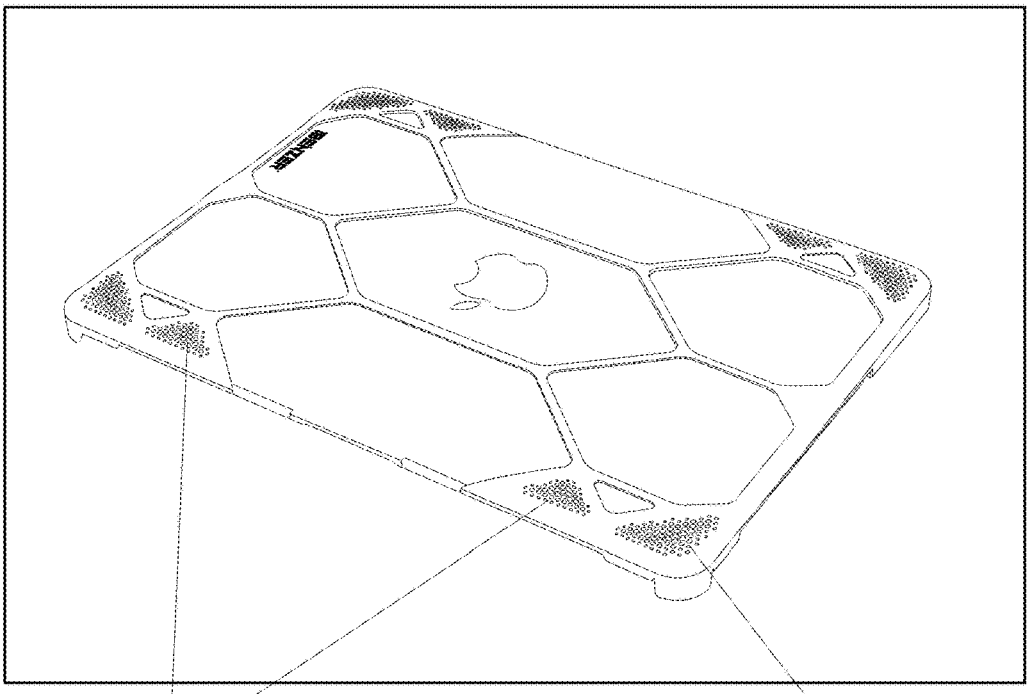
FIG. 6 is a schematic illustration of the case while fitted onto the computing device.
Figure 7:
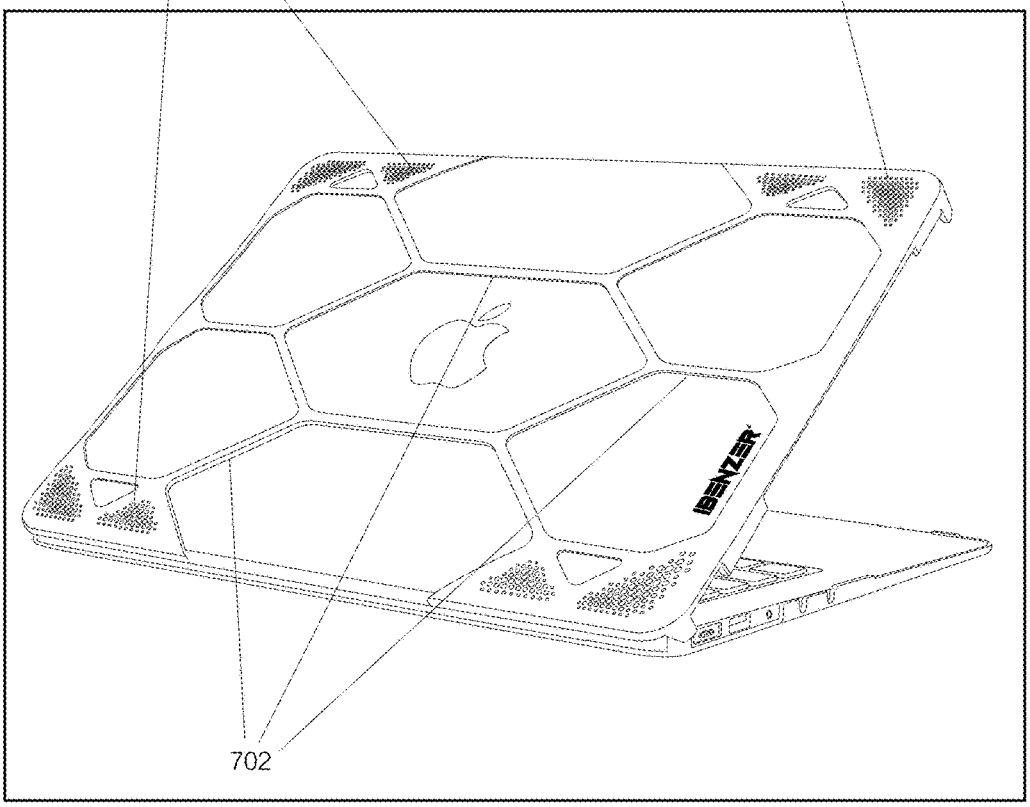
FIG. 7 is another schematic illustration of the case when the computing device is in an opened position.

FIGS. 6 and 7 illustrate examples of a laptop fitted with the case while in a closed or an opened position.

Laptops or handheld tablets and phones typically have battery compartments, which generate a fair amount of heat during operation. While completely covering the device may protect the device from forceful impact or scratches, it increases the overall weight of the device and hinders the dissipation of heat. Chronic over heating of the device itself can cause internal damage or even fire. In the present disclosure, the structure of the protective case is designed to accommodate both physical protection and heat dissipation without adding too much extra weight when fitted onto the device. For layers 101 and 103, larger openings 111 are organized and distributed around a central region of the case. Smaller openings 113 are organized and distributed around corners and edges of the case. For base layer 105, multiple sets of slits 115 and the raising feet 107 also facilitate the release of heat.

Figure 3:
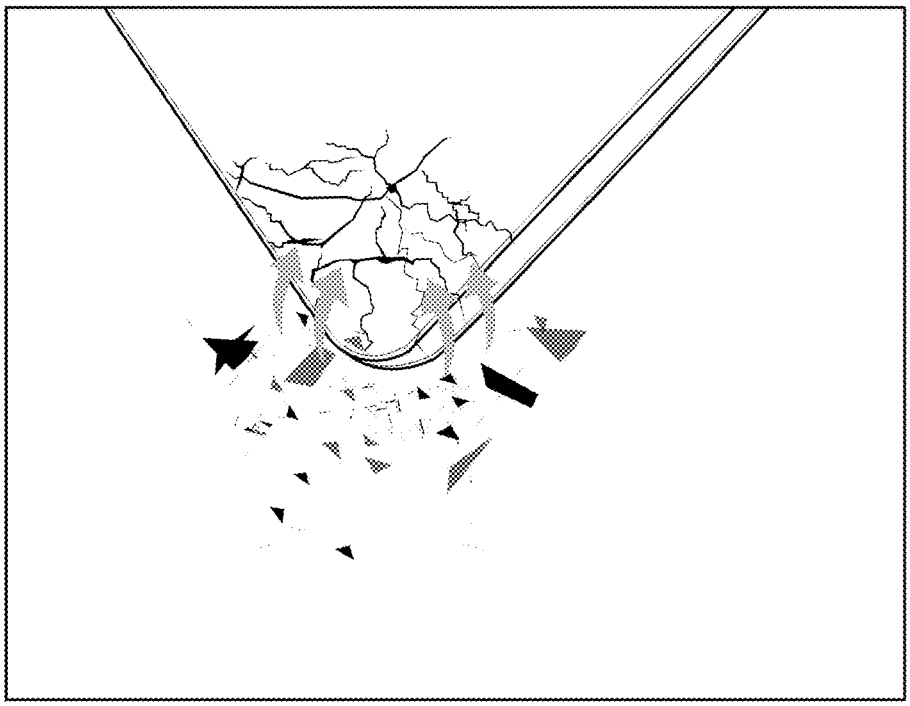
FIG. 3 is a schematic illustration of the breakage of a case due to impact.
Figure 4:
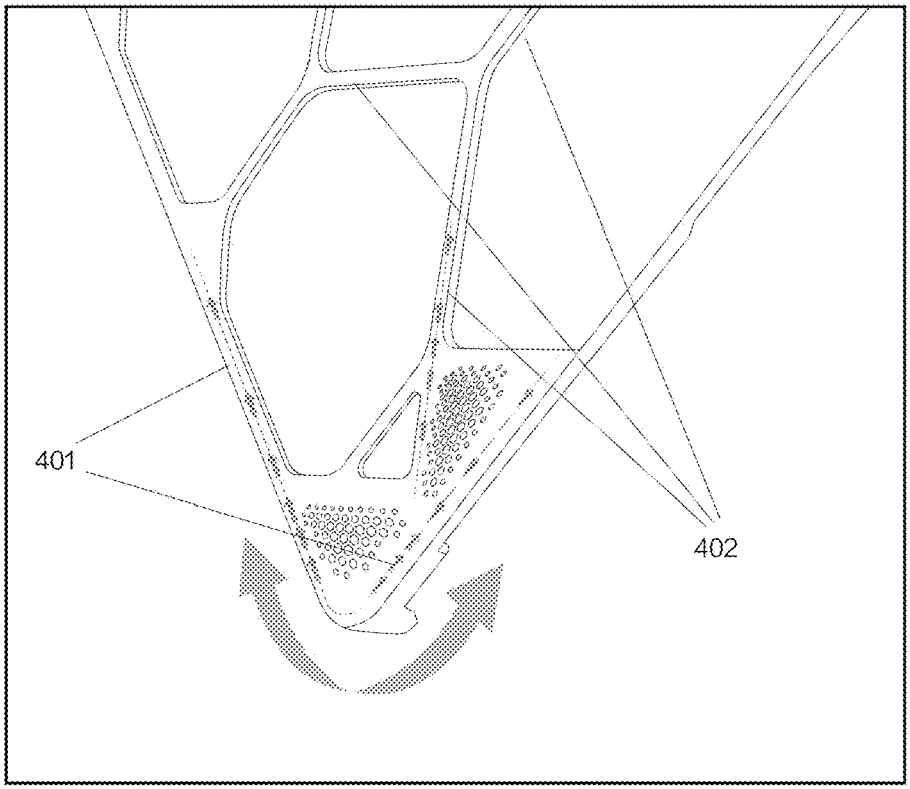
FIG. 4 is a schematic of impact force distributions around a corner of the case.
Figure 5:
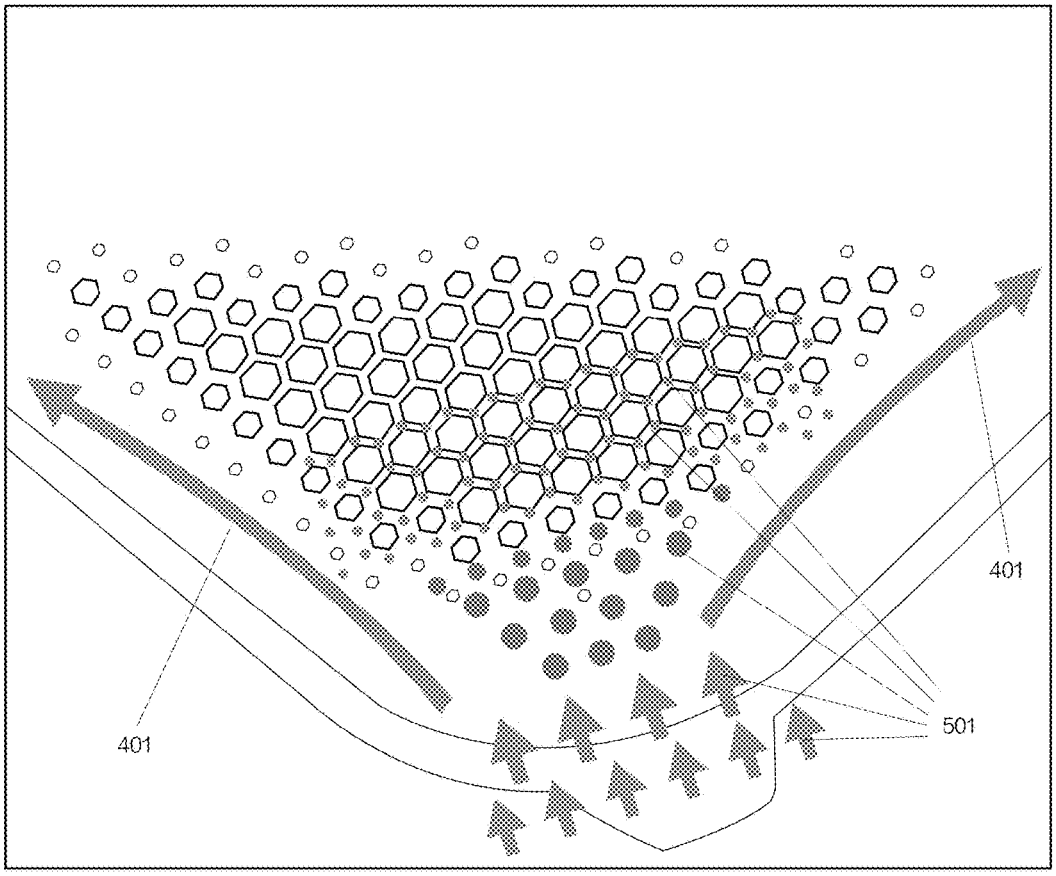
FIG. 5 is a further enlarged view of FIG. 4.

While large and small openings and slits reduce weight and facilitate heat dissipation, their spatial arrangements are structured to dissipate physical force generated by impacts. FIGS. 3-5 illustrate a few examples. Corners and edges are the most vulnerable areas for obvious reasons. FIG. 3 illustrates a moment when a corner of a laptop and its casing forcefully encounter a hard surface. The impact causes the material of the casing to shatter and crumble around its immediate vicinity.

FIGS. 4 and 5 illustrates two pathways for force to dissipate when the case and device is hit in a manner similar to that of in FIG. 3. The arrows in FIG. 4 mark the mainframe pathway along which force propagates. The mainframe pathway comprises edges 401 and large structural trunks 402 across the entire surface of the case. Parallel arrows and dots in FIG. 5 illustrate a secondary pathway 501 for force propagation, comprising smaller openings structured and clustered right at the corner. FIGS. 6 and 7 illustrate examples where a similar small cluster 601 is distributed along the edges, next to another cluster 602 at the corners.

In order for force to propagate effectively, the rigidity of the material needs to be taken into consideration. The protective layer 101 comprises mainly harder material, such as thermoplastic polyurethane (TPU). TPU is known for resisting wear and fading, and is relatively light in weight. The cushion layer 103 and the bottom layer 105 comprise slightly softer materials, such as silicone or polycarbonate (PC), which are commonly used to provide shock resistance.

Figure 8:
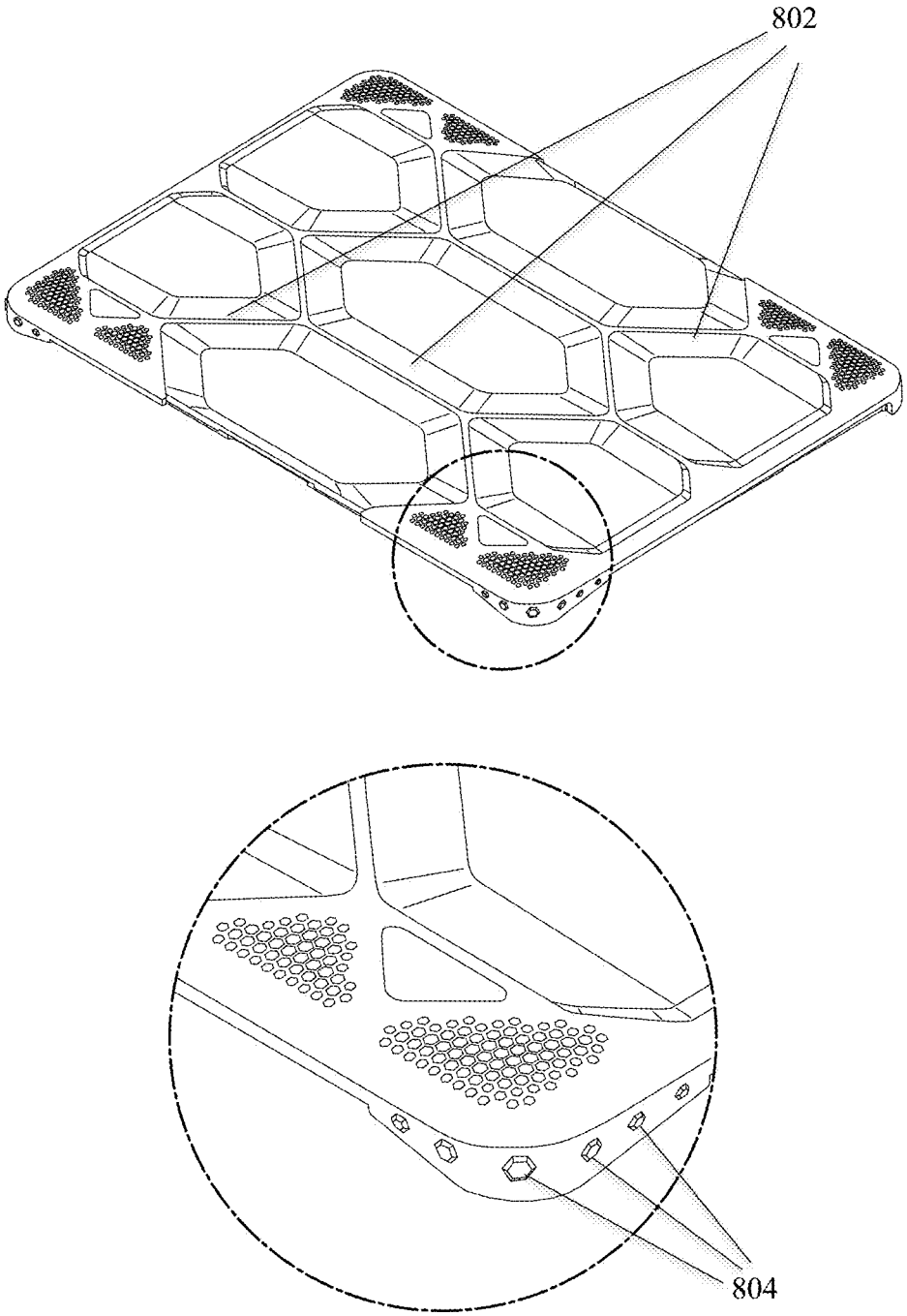
FIG. 8 is a schematic drawing of a perspective view of a variation of the cased with one of the corners enlarged, according to some embodiments of the present disclosure.

FIG. 8 illustrates an example where the large structural trunks 802 are much thicker than that of illustrated as 702 in FIG. 7. Protrusions 804 can be employed around the outside of the corners and edges as extra buffers and cushions. A thicker structural trunk covers or protects more surface area of the device, increases the overall weight when assembled, and retains more heat. A thinner structural trunk covers or protects less surface area of the device, decreases the overall weight, and helps to dissipate heat more easily. There is a trade of among the desired qualities such as weight, surface area coverage, and heat dissipation etc. Customization can be done based on the nature and the need of the device at hand.

When a handheld device is a tablet or a phone, base layer 105 is no longer needed. Layers 101 and 103 together directly engage the device around its corners and perimeters. The width, length, and thickness dimensions of the case will also be customized to fit those devices accordingly.

Figure 9:
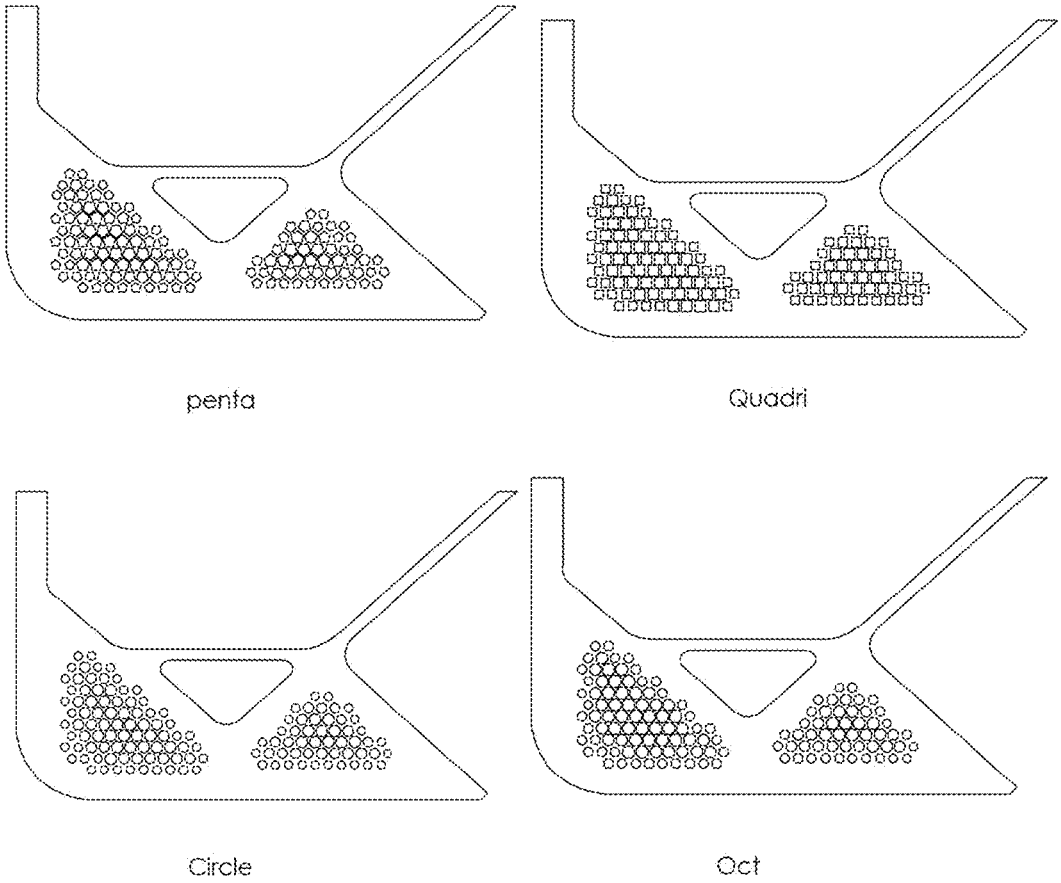
FIG. 9 is a schematic drawing of variations of patterns around one of the corners.

Hexagons are consistently used in examples from FIG. 1 to FIG. 8 for illustration purpose. FIG. 9 illustrates a few examples where the small opening clusters are of different shapes, such as a pentagon, a quadrangle, a circle, and an octagon. It should be noted that other geometric shapes could also be used in substitute. Apart from the small cluster openings, large openings bordered by main structural trunks and edges can also take on geometric shapes other than hexagons. A combination of different shapes could also work so long as the distribution of large and small openings follow the general pattern as illustrated previously.

Figure 10:
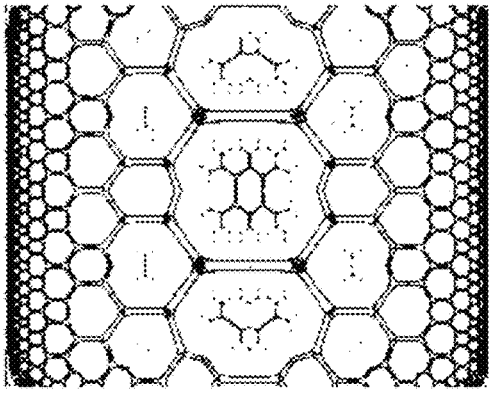
FIG. 10 is a schematic drawing of a pattern with larger openings around a central region and smaller openings towards edges and corners according to some embodiments of the present disclosure
Figure 11:
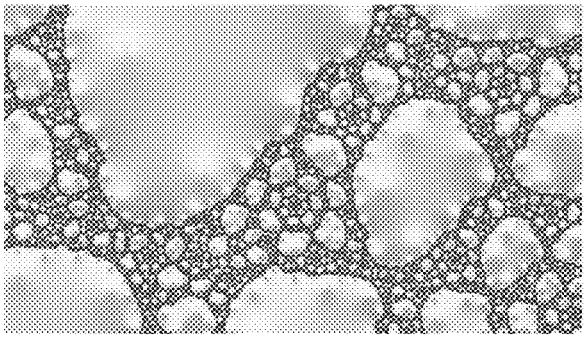
FIG. 11 is a variation of a pattern according to some embodiments of the present disclosure.
Figure 12:
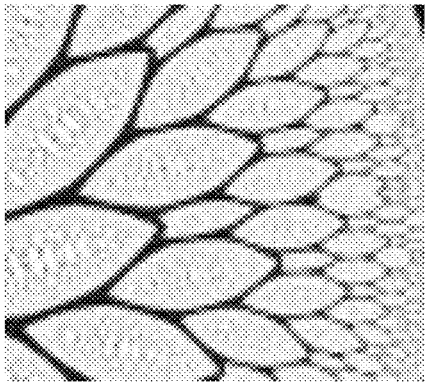
FIG. 12 is another variation of a pattern according to some embodiments of the present disclosure.
Figure 13:
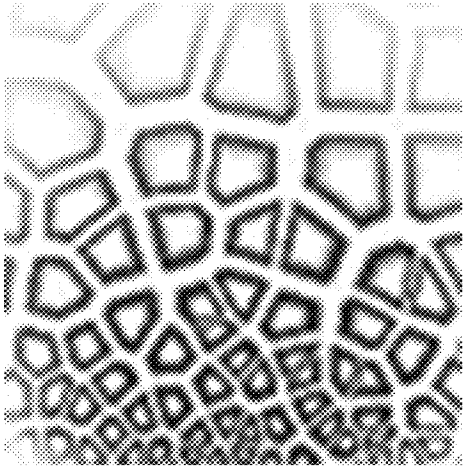
FIG. 13 is yet another variation of a pattern according to some embodiments of the present disclosure.

FIGS. 10 and 12 illustrate examples of structural patterns generated via a fractal equation. FIGS. 11 and 13 illustrate examples of structural patterns from nature. The patterns in these examples all share a few common characteristics in terms of their distribution density and size. Geometrically regular or completely irregular shapes form larger openings sparsely abutting on another in one region. Smaller openings with similar shapes form a gradient into a neighboring region, while increase in density and decrease in size. Although it is impossible to illustrate all possible patterns, the present disclosure of a protective case supports the idea that larger openings are generally located around the central regions of a device, while smaller openings are clustered around corners or distributed along edges of the device. The change in size can be gradual, as well as in predefined steps. Patterns illustrated in FIGS. 10-13 can all be customized to make a protective case according to the embodiments previously disclosed.

While various embodiments of the present disclosure have been described above, it should be understood that they have been presented by way of example only, and not of limitation. Likewise, the various diagrams may depict an example architectural or other configuration for the disclosure, which is done to aid in understanding the features and functionality that can be included in the disclosure. The disclosure is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus the breadth and scope of the present disclosure should not be limited by any of the above-described exemplary embodiments.

Terms and phrases used in this document, and variations thereof, unless otherwise expressly stated, should be construed as open United as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A protective case for a portable computing device, comprising:

a first protective layer configured to enclose and to capture at least a portion of a body and a portion of a perimeter of the computing device, wherein the first protective layer further comprises a structure with large connected openings distributed around a central region of the body of the computing device surrounded by clusters of small connected openings, wherein the structure of the large and small openings follows a fractal pattern with density of the fractal pattern increases towards edges and corners of the computing device;

a second cushion layer, disposed between the first protective layer and the computing device, configured to mirror and to interlock with the structure of the first protective layer; and a third base layer to support the computing device on a resting surface, wherein the base layer further comprises multiple sets of slits to facilitate heat dissipation.

2. The protective case of claim 1, wherein the large connected openings comprises polygons with abutting edges and corners.

3. The protective case of claim 1, wherein the small connected openings comprises polygons with abutting edges and corners.

4. The protective case of claim 1, wherein the large connected openings are circular in nature.

5. The protective case of claim 1, wherein the small connected openings are circular in nature.

6. The protective case of claim 1, wherein the large connected openings comprises irregular shapes abutting one another.

7. The protective case of claim 1, wherein the small connected openings comprises irregular shapes abutting one another.

8. The protective case of claim 1, wherein the first protective layer comprises mainly thermoplastic polyurethane.

9. The protective case of claim 1, wherein the second cushion layer comprises mainly polycarbonate.

10. The protective case of claim 1, wherein the third base layer further comprises at least one pair of feet to raise the base layer above a resting surface.

11. A protective case for a portable computing device, comprising:

a first protective layer configured to enclose and to capture at least a portion of a body and a portion of a perimeter of the computing device, wherein the first protective layer further comprises a structure with large connected openings distributed around a central region of the body of the computing device surrounded by clusters of small connected openings, wherein the structure of the large and small openings follows a fractal pattern with density of the fractal pattern increases towards edges and corners of the computing device; and a second cushion layer, disposed between the first protective layer and the computing device, configured to mirror and to interlock with the structure of the first protective layer.

12. The protective case of claim 11, wherein the large and small connected openings comprises polygons with abutting edges and corners.

13. The protective case of claim 11, wherein the large and small connected openings are circular in nature.

14. The protective case of claim 11, wherein the large and small connected openings comprises irregular shapes abutting one another.

15. The protective case of claim 11, wherein the first protective layer comprises mainly thermoplastic polyurethane.

16. The protective case of claim 11, wherein the second cushion layer comprises mainly polycarbonate.

17. The protective case of claim 1, wherein the first protective layer further comprises at least one protrusion around its corners.

18. The protective case of claim 11, wherein the first protective layer further comprises at least one protrusion around its corners.

* * * * *